United States Patent [19]

Nomura

[11] Patent Number: 4,746,305

[45] Date of Patent: May 24, 1988

[54] HIGH FREQUENCY COAXIAL CONNECTOR

[75] Inventor: Shinji Nomura, Yokohama, Japan

[73] Assignee: Taisho Electric Industrial Co. Ltd., Tokyo, Japan

[21] Appl. No.: 42,134

[22] Filed: Apr. 24, 1987

[30] Foreign Application Priority Data

Sep. 17, 1986 [JP] Japan ..... 61-143187[U]

[51] Int. Cl.[4] ..... H01R 13/62

[52] U.S. Cl. ..... 439/319; 439/578; 439/585

[58] Field of Search ..... 439/311, 312, 314, 317, 439/318, 319, 578–585

[56] References Cited

U.S. PATENT DOCUMENTS

| | | | |
|---|---|---|---|
| 2,762,025 | 9/1956 | Melcher | 439/580 |
| 3,332,052 | 7/1967 | Rusinyak | 439/318 |
| 3,391,380 | 7/1968 | Robinson et al. | 439/583 |
| 3,605,069 | 9/1971 | Bunker-Ramo | 439/311 |
| 3,685,004 | 8/1972 | Kerr | 439/314 |
| 4,340,269 | 7/1982 | McGeary | 439/583 |
| 4,494,810 | 1/1985 | Schildkraut | 439/312 |

*Primary Examiner*—Gil Weidenfeld
*Assistant Examiner*—David Pirlot
*Attorney, Agent, or Firm*—Jordan & Hamburg

[57] ABSTRACT

A high frequency coaxial connector having a bayonet-tight insertion arrangement for use in a high frequency coaxial circuit, is constructed with an outer installation and an inner installation. The outer installation comprises an external locking sleeve, an internal contact sleeve, a cylindrical insulation body tightly inserted in a contact portion of the internal contact sleeve, an outer insulation sleeve, and a coil spring, one end of which is directly brought into contact with the rear edge of a stopper portion of the internal contact sleeve, and the other end of which is directly brought into contact with the rear edge inner wall of the outer insulation sleeve. The inner installation comprises of a unitarily constructed central contact pin, an insulation plate having a front surface directly brought into contact with a rear edge of the contact pin, and an inside sleeve receiving the insulating plate and the insulating body of the coaxial cable.

5 Claims, 4 Drawing Sheets

101
101a
101b
101b
101a 102
102a
102b 103
103a
103b
103c
103d
103e

104

105
105a
105b
105c
105d
105e
105f 101
102
103
103a
104
105

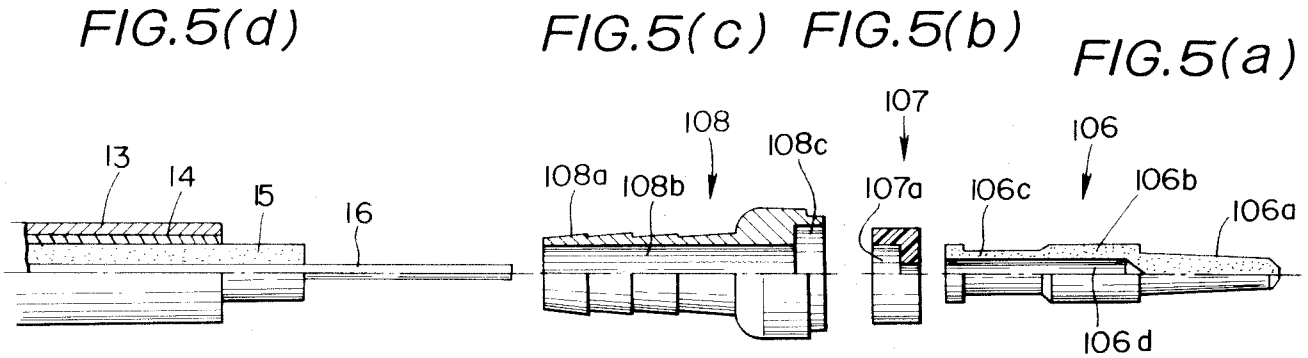
FIG.5(a)
FIG.5(b)
FIG.5(c)
FIG.5(d)
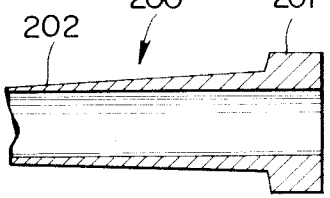
FIG.6
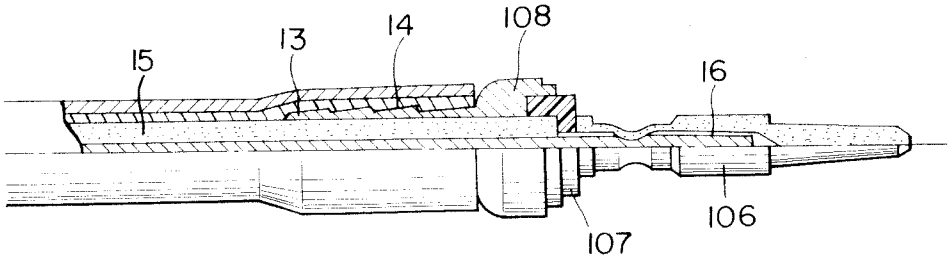
FIG.5(e)

HIGH FREQUENCY COAXIAL CONNECTOR

BACKGROUND OF THE INVENTION

The present invention relates to the construction of a small-sized light high frequency coaxial connector utilizing a bayonet-tight insertion arrangement.

The small-sized connector for use in an electronic apparatus is standardized by a "CO2-type high frequency coaxial connector" of JIS-C-5412.

A coaxial cable is used in connection with such a high frequency coaxial connector. The procedure for connecting the coaxial cable to the above-mentioned connector is as follows.

A part of a coaxial cable's sheath is removed without damaging the shield, i.e. a knitted mantle composed of an external conductor. The knitted mantle of the external conductor is unbound and further a dielectric material such as polyethylene, which is an insulation body, is removed thus leaving an internal lead wire. The tip end of the unbound knitted mantle is made narrower and the coaxial cable is inserted, in order, through a tightly-binding metal fixture, a metal washer, a gasket and a clamp. An internal lead wire is inserted into a hole formed in a central contact and fixed thereto by pouring solder into a soldering hole. The unbound knitted mantle of the external lead wire is bent along the surface of the tapered clamp. The central contact is inserted into the insulation body and the external lead wire is connected with the shell by tightly fastening the metal fixture. The coaxial cable is pressed by the gasket and unitarily fixed together with the connector.

In the above-mentioned prior art, the internal lead wire is fixed to the central contact by soldering. After unbinding the knitted mantle of the external shield lead wire, the external shield lead wire is uniformly bent along the surface of the clamp and the coaxial cable is screwed and fixed to the connector by the use of an inserting and tightly-binding metal fixture. The prior art required such a large number of work processes. And further, since the coaxial connector of the prior art was made of metal such as brass or the like, except for the insulating body itself, which consisted of dielectric material, the total weight thereof increased inevitably and the cost became high. Furthermore, since the spring metal washer, employed for performing bayonet-tight combining, caused small compression displacement and much stiffness, the same also changed its shape like plastic and caused a loss of plasticity when the same was mounted or removed very frequently.

SUMMARY OF THE INVENTION

It is an object of the present invention to provide a high frequency coaxial connector for eliminating the steps of the working process such as unbinding the knitted mantle of the external shield lead wire, fixing by the use of solder. It is another object of the present invention to provide a high frequency coaxial contact for decreasing the weight of the parts.

The above-mentioned features and other advantages of the present invention will be apparent from the following detailed description which goes with the accompanying drawings.

BRIEF DESCRIPTION OF THE DRAWINGS

FIGS. 5*a* through 5*e* are cross-sectional views showing the dissolved inner installation's elements, the coaxial cable, and the way of connecting the coaxial cable with the inner installation; and FIG. 6 is a cross-sectional view of bushing cover for covering the press-contact portion of the coaxial cable of the high frequency coaxial connector.

DESCRIPTION OF THE PREFERRED EMBODIMENTS

Figure 1:
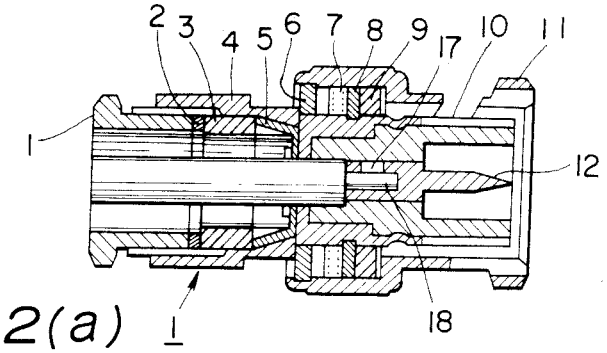
FIG. 1 is a cross-sectional view showing a prior art type connector assembly standardized by the standard JIS-C-5412 'High Frequency Coaxial Connector'.

FIG. 1 is a cross-sectional view showing a connector standardized by the afore-mentioned standard JIS-C-5412. In FIG. 1, 1 is a tightly-binding metal fixture; 2, 6, 8 metal washers; 3, 9 gaskets; 4 a shell; 5 a clamp; 7 a spring metal washer; 10 an insulation body; 11 a connecting sleeve and 12 is a central contact.

Figure 2A:
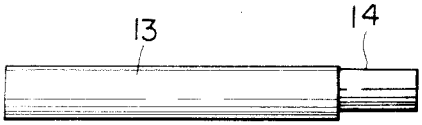
FIGS. 2*a* through 2*e* are structural views showing procedure for assembling the coaxial cable of FIG. 1.
Figure 2B:
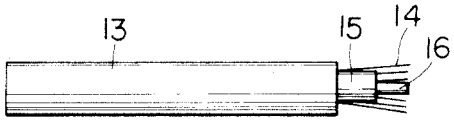
Figure 2C:
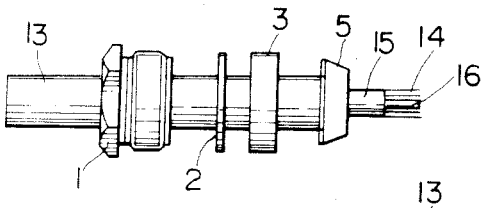
Figure 2D:
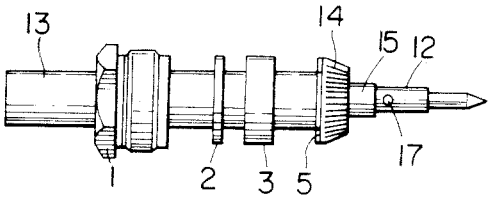
Figure 2E:
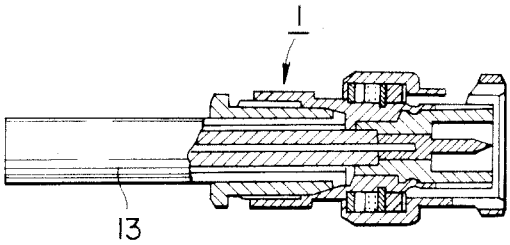

FIGS. 2*a* through 2*e* are structural views showing a procedure for connecting a coaxial cable with the high frequency coaxial cable's connector as shown in FIG. 1. In FIG. 2*a*, a cable's sheath 13 is removed without hurting the shield, i.e. a knitted mantle, composed of an external conductor 14. In FIG. 2*b*, the knitted mantle made of an external conductor 14 is unbound and a dielectric material such as polyethylene, which is an insulating body 15, is removed leaving an internal lead wire 16. In FIG. 2*c*, the tip end of the unbound knitted mantle 14 is made narrower and the coaxial cable is inserted, in order, through the tightly-binding metal fixture 1, the metal washer 2, the gasket 3 and the clamp 5. In FIGS. 1 and 2*d*, an internal lead wire 16 is inserted into a bore 18, formed in a central contact 12 and fixed thereto by pouring solder into a bore 18 through soldering hole 17. The unbound knitted mantle of the external lead wire 14 is bent along the surface of the tapered clamp 5. In the state of FIG. 2*d*, the central contact 12 is inserted into the insulated body 10 (see FIG. 1) and the external lead wire 14 is connected with the shell 4 by tightly fastening the metal fixture 1. The coaxial cable is pressed by the gasket 3 and unitarily fixed together with the connector 1 constructed as mentioned before. In such a manner as mentioned heretofore, the steps for connecting and assembling those parts are completed as shown in FIG. 2*e*.

In the above-mentioned prior art, the internal lead wire 16, fixed to the central contact 12 by soldering after unbinding the knitted mantle of the external lead wire 14, the external lead wire 14 is uniformly bent along the surface of the clamp 5, and the coaxial cable is screwed and fixed to the connector 1 by the use of an inserting and tightly-binding metal fixture. The prior art required such a large number of steps. And further, since the coaxial connector of the prior art was made of metal such as brass or the like, except for the insulating body 10 consisting of dielectric material, the total weight thereof increased inevitably and the cost became high. Furthermore, since the spring metal washer 7, employed for performing bayonet-tight combining caused some compression displacement and much stiffness, the same also changed its shape, like plastic, and lost its spring effect when it was mounted or removed very frequently.

Figure 3:
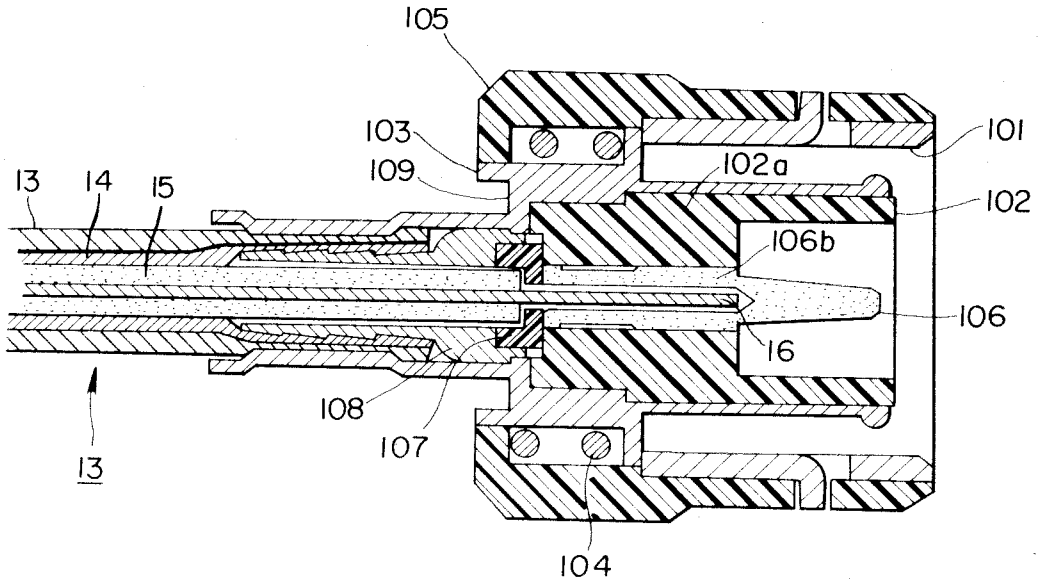
FIG. 3 is a cross-sectional view showing a cross-section of a high frequency coaxial connector assembly according to the present invention.

FIG. 3 is a cross-sectional view showing a cross section of an assembly in which a coaxial cable is connected with a high frequency coaxial connector, according to the present invention's embodiment. In FIG. 3, 101 is an external locking sleeve, 102 an insulation body, 103 an internal contact sleeve, 104 a coil spring, and 105 an insulation sleeve for the outer installation. The afore-mentioned parts 101 to 105 are the elements for constructing the connector's outer installation.

Figures 4A, 4B, 4C, 4D, 4E, 4F:
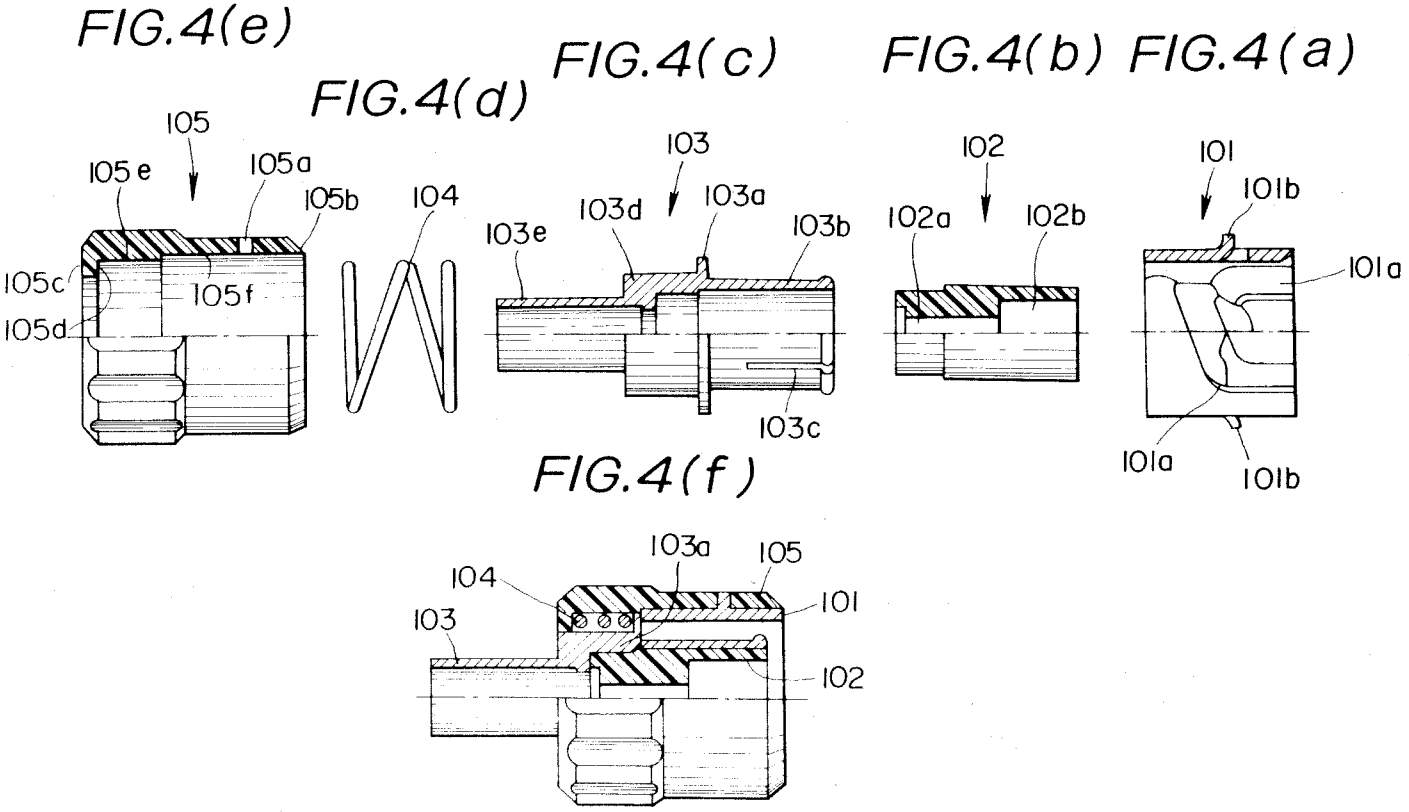
FIGS. 4*a* through 4*f* are fragmentary cross-sectional views of its dissolved outer installation's parts.

FIGS. 4*a* through 4*f* are fragmentary cross-sectional views of dissolved parts for explaining the details of the above-mentioned outer installation. FIG. 4*a* is a view showing an external locking sleeve 101. With respect to the external locking sleeve 101, in order to perform a bayonet-tight connection with an opposite (female) connector (not shown in the figure) and to perform unitary construction with an insulation sleeve 105 of the outer installation, a connecting sleeve groove 101*a* for performing a bayonet-tight connection with the opposite female connector and a claw 101*b* for joining the external locking sleeve 101 with the insulation sleeve are formed by the process of mechanical pressing on a rectangular brass plate, and the edge portions of the rectangular brass plate joined with each other and formed into a cylindrical shape.

FIG. 4*b* shows an insulation body 102 made of dielectric material such as polyethylene resin or the like. An insertion hole 102*a* for inserting the central contact pin 106 therethrough and recess portion 102*b* coaxial with the hole 102*a* are bored in the insulation body 102. The insulation body 102 consists of a high frequency insulation body for insulating the central contact pin 106 from the internal contact sleeve 103.

FIG. 4*c* shows an internal contact sleeve 103. A plurality of contact portions 103*b* provided with grooves 103*c* are formed along the axis of the contact sleeve 103, and the insulation body 102 is pressed into contact with the inner surface of the contact portion 103*b*. The internal contact sleeve 103 has a contact portion 103*b* formed at one side of a flange shaped, stopper portion 103*a* and has a cylindrical portion 103*d* and a lead wire fixing and caulking portion 103*e* on another side thereof. Both of the portions 103*d* and 103*e* are formed coaxially and unitarily. And further, the internal contact sleeve 103 has an insertion hole for inserting the coaxial cable 13 therethrough.

FIG. 4*d* shows a coil spring 104. The coil spring 104 elastically connects and stops the joining pin of the opponent female connector, fixedly mounted on the connecting sleeve groove 101*a* of the external locking sleeve 101, at the time of performing the bayonet-tight connection.

FIG. 4*e* shows an external insulation sleeve 105 made of resin. The external insulation sleeve 105 is formed by the method of plastic molding in the shape of a cylinder. The inner circumference of the rear edge 105*c* has a diameter a little larger than the outer diameter of the cylindrical portion 103*d* so as to make slidable the outer circumference of the cylindrical portion 103*d* of the internal contact sleeve 103. And further, the outer circumference of the internal contact sleeve 103's stopper portion 103*a* is capable of sliding along the inner surface 105*e* of the rear cylinder which is smoothly joined to the inner wall 105*d* of the rear edge 105*c*. The coil spring 104 is installed in a space formed by the side surface of the stopper portion 103*a*, the cylindrical portion 103*d*, the inner surface 105*e* of the rear cylinder, and the inner wall 105*d* of the rear edge. The end portions of the coil spring 104 are pressedly brought into contact with the inner wall 105*d* of the rear portion and the side surface of the striking stopper portion 103*a*, respectively. And further, the external locking sleeve 101 is inserted into the front inner cylindrical surface 105*f* of the insulation sleeve 105 of the outer installation, and the claw 101*b* of the external locking sleeve 101 is bent and inserted into the locking hole 105*a* formed on the insulation sleeve 105 of the outer installation and connectingly stopped therein.

FIG. 4*f* shows a structural view of the outer installation assembly of the coaxial connector unitarily constructed by inserting the afore-mentioned respective elements of the outer installation.

FIGS. 5*a* through 5*e* are cross-sectional views of the dissolved inner installation's elements, a cross-sectional view of the coaxial cable, and a cross-sectional view showing the state of connecting the coaxial cable with the inner installation. As shown in FIG. 3, 106 is a central contact pin, 107 an insulation plate, and 108 an inside sleeve. The above-mentioned central contact pin 106 and other elements make up the inner parts of the coaxial connector. As shown in FIG. 5*a*, the central contact pin 106 is unitarily constructed with a tapered contact portion 106*a*, a holding portion 106*b*, and a pressed contact portion 106*c*. The external portion thereof is plated with gold for preventing it from being oxidized. An insertion hole 106*d* is bored through the central contact pin 106 in the axis direction thereof, for inserting the internal lead wire 16 the coaxial cable shown in FIG. 5*d*.

FIG. 5*b* shows an insulation plate 107 consisting of dielectric material such as polyethylene or the like. A recess portion 107*a* is formed for inserting the cut transverse section surface of the insulating body 15 of the coaxial cable into the same and for directly bringing them into contact therewith.

FIG. 5*c* shows an inside sleeve 108 which is a cylinder made of brass plated with nickel or the like for preventing the occurrence of rust. The external lead wire 14 of the coaxial cable is partly cut off without unbinding the knitted mantle thereof together with the sheath (crust) 13 of the same. The inside sleeve 108 is squeezed between the insulating body 15 and the external lead wire 14 as shown in FIG. 5*e*. The inserted portion of the inside sleeve 108 has an outer circumferential surface consisting of several step portions 108*a*. Those step portions have a tapered (inclined) step in order to facilitate the insertion of an inside sleeve 108. The insulation body 15 is inserted into hole 108*b*. The end portion of the insulation body 15 directly comes into contact with the recess portion 107*a* of the insulation plate 107 as shown in FIG. 5*e*. The insulation plate 107 is inserted into the recessed portion 108*c* formed at the rear end of the inside sleeve 108.

FIG. 5*e* shows a combination of the inner installation and the coaxial cable which are connected with each other as mentioned above in a cross-sectional structural view.

The construction technique of the inner parts has been described heretofore. In the present invention, the external lead wire 14 of the coaxial cable is cut off together with the sheath 13 and the insulation body 15 is also cut off so as to form three steps of the internal lead wire 16, the insulation body 15, and the sheath 13. The internal lead wire 16 is inserted into the insertion hole 106*d* of the central contact pin 106 as shown in FIG. 5*e*. At the time of unitarily joining the insulation plate 107 and the inside sleeve 108, the internal lead wire 16 is pressed into contact with the contact portion 106*c* of the central contact pin 106 by caulking the latter. In such a manner as mentioned heretofore, after unitarily assembling the outer installation and the inner installation respectively as shown in FIGS. 4*f* and 5*e*, the coaxial cable is fixed by using hexagonal caulking at the lead wire fixing and caulking portion 103*e* of the internal contact sleeve 103, at the place where the holding portion 106*b* of the inner installation's central contact pin 106 is inserted into the insertion hole 102*a* of the outer installation's insulation body 102 as shown in FIG. 3. After fixing the coaxial cable, the fixed portion thereof is covered with a bushing cover 200 made of elastic material such as rubber or the like shown in FIG. 6. The bushing cover 200 is fixed to a ring-shaped recess portion 109 (which is not shown in 103 of FIG. 4*c*) formed at the rear edge surface of the internal contact sleeve 103's cylindrical portion 103*d* shown in FIG. 3 in such a manner that a projecting (thickened) portion 201 of the bushing cover 200 is elastically pressed to the recess portion 109. The tapered cover 202 contains therein the internal contact sleeve 103 and covers the area coming up to the sheath 13.

As is apparent from the foregoing description, the high frequency coaxial connector, according to the present invention, is capable of eliminating the inefficient steps such as the treatment of the knitted mantle of the coaxial cable's external lead wire, the soldering of the internal lead wire, the screwing-in of the metal fixtures containing therein the gasket and the metal washer at the time of assembling, and so on, all of which are done by the assembly of the high frequency coaxial CO2-type connector, standardized hitherto by the standard JIS-C-5412. Furthermore, the coaxial connector according to the present invention is assembled by strong press-contact methods. For the reason of the above-mentioned, the number of steps required can be largely decreased. Consequently, efficiency can be obtained, especially for mass production. And further, the insulation sleeve of the outer installation which tends to be heavy in the previous construction is made of resin molding in the new invention, and the external lock sleeve is formed by the metal plate process. In such a manner, it is possible to decrease the total weight of the coaxial connector. Furthermore, a coil spring is employed as the spring for bayonet-tight connections so that the coaxial connector is stable for a long period of time and thus its reliability is largely improved.

I claim:

1. A high frequency coaxial cable connector of the bayonet type for use with a high frequency coaxial cable of the type having an internal lead wire;

an outer installation means and an inner installation means;

said outer installation means comprising an external locking sleeve having a bayonet connection groove and a connecting claw, an internal contact sleeve having a longitudinal end portion coaxially disposed within said external locking sleeve, said internal contact sleeve having an internal contact portion and an external flange stopper, said flange stopper being in contact with one longitudinal end of said external locking sleeve, said internal contact sleeve also having a receiving portion for receiving said coaxial cable, a cylindrical insulating body having an internal opening and an external contact section received in said contact portion of said internal contact sleeve, an outer insulation sleeve having one part disposed about said external locking sleeve and another part about an intermediate portion of said internal contact sleeve such as to provide a gap between said another part of said outer insulation sleeve and said intermediate portion of said internal contact sleeve, said outer insulation sleeve having a longitudinal rear edge wall, a coil spring within said gap and disposed between said rear edge wall of said outer insulation sleeve and said flange stopper of said internal contact sleeve, said outer insulation sleeve having a locking opening for receiving said connecting claw of said locking sleeve to thereby lock said locking sleeve and said outer insulation sleeve together, said inner installation means comprising a central contact pin having an external support portion disposed in said internal opening of said cylindrical insulating body of said outer installation means, said central contact pin receiving said internal lead wire of said coaxial cable, said central contact pin having an inner longitudinal end, an insulation plate in contact with said inner longitudinal end of said central contact pin, and an inside sleeve extending into said receiving portion of said internal contact sleeve of said outer installation means and having a longitudinal end recess for receiving said insulation plate.

2. A high frequency coaxial cable connector according to claim 1 wherein said inside sleeve has an internal passage receiving said insulation body and said internal lead wire of said coaxial cable, said external conductor and said sheath of said coaxial cable being disposed between said inside sleeve and said receiving portion of said internal contact sleeve.

3. A high frequency coaxial cable connector according to claim 1 wherein said coaxial cable is of the type having an outer sheath, an external conductor, an insulation body, and an internal lead wire, said inner installation means being constructed as a unitary unit and being inserted into said outer installation means to dispose said external conductor and said sheath of said coaxial cable between said inside sleeve of said inner installation means and said receiving portion of said internal contact sleeve of said outer installation means.

4. A high frequency coaxial cable connector according to claim 3 wherein said insulation plate has a recess receiving a longitudinal end portion of said insulation body of said coaxial cable.

5. A high frequency coaxial cable connector of the bayonet type for use with a high frequency coaxial cable of the type having an internal lead wire, an insulation body, an external conductor, and an outer sheath comprising:

an outer installation means and an inner installation means;

said outer installation means comprising an external locking sleeve having a bayonet connection groove and an outwardly extending claw, an internal contact sleeve having a longitudinal end portion coaxially disposed within said external locking sleeve, said longitudinal end portion of said internal contact sleeve having a plurality of axially extending grooves, said internal contact sleeve having an internal contact portion and an external flange stopper, said flange stopper being in contact with one longitudinal end of said external locking sleeve, said internal contact sleeve also having a fixing portion for fixing therewith said coaxial cable, a cylindrical insulating body having an internal opening and an external contact section received in said contact portion of said internal contact sleeve, an outer insulation sleeve having one part disposed about said external locking sleeve and another part about an intermediate portion of said internal contact sleeve such as to provide a gap between said another part of said outer insulation sleeve and said intermediate portion of said internal contact sleeve, said outer insulation sleeve having a longitudinal rear edge wall, a coil spring within said gap and disposed between said rear edge wall of said outer insulation sleeve and said flange stopper of said internal contact sleeve, said outer insulation sleeve having a locking opening for receiving said claw of said locking sleeve to thereby lock said locking sleeve and said outer insulation sleeve together whereby said locking sleeve and said outer insulation sleeve are unitarily longitudinally slidable relative to said internal contact sleeve in opposition to the bias of said coil spring, said inner installation means comprising a central contact pin having a contact portion and an external support portion disposed in said internal opening of said cylindrical insulating body of said outer installation means, said central contact pin having an internal passage for receiving the internal lead wire of said coaxial cable, said central contact pin having an inner longitudinal end, an insulation plate in contact with said inner longitudinal end of said central contact pin, said insulation plate having an internal opening through which said internal lead wire of said coaxial cable passes, said insulation plate also having a recess receiving a longitudinal end portion of the insulation body of said coaxial cable, and an inside sleeve extending into said fixing portion of said internal contact sleeve of said outer installation means and having a longitudinal end recess for receiving said installation plate, said inside sleeve having an internal passage receiving the insulation body and internal lead wire of said coaxial cable, the external conductor and the sheath of said coaxial cable being disposed between said inside sleeve and said fixing portion of said internal contact sleeve.

* * * * *